United States Patent [19]

Hensler

[11] Patent Number: 4,562,652

[45] Date of Patent: Jan. 7, 1986

[54] SHOE OR BOOT

[75] Inventor: Adolf Hensler, Köflach, Austria

[73] Assignee: Koflach Sportgerate Gesellschaft m.b.H., Vienna, Austria

[21] Appl. No.: 550,459

[22] Filed: Nov. 10, 1983

[30] Foreign Application Priority Data

Nov. 12, 1982 [AT] Austria ..... 413282

[51] Int. Cl.[4] ..... A43B 01/10; A43B 23/00

[52] U.S. Cl. ..... 36/102; 36/45

[58] Field of Search ..... 36/102, 45, 117

[56] References Cited

U.S. PATENT DOCUMENTS

| | | | |
|---|---|---|---|
| 1,974,543 | 9/1934 | Reymond | 36/45 |
| 3,213,551 | 10/1965 | Krauss | 36/102 |
| 3,535,800 | 10/1970 | Stohr | 36/45 |
| 4,354,319 | 10/1982 | Block et al. | 36/45 |
| 4,393,605 | 7/1983 | Spreng | 36/45 |

FOREIGN PATENT DOCUMENTS

| | | | |
|---|---|---|---|
| 0086149 | 8/1983 | European Pat. Off. | 36/117 |
| 2409907 | 10/1974 | Fed. Rep. of Germany | |
| 460605 | 12/1913 | France | 36/45 |

*Primary Examiner*—Werner H. Schroeder
*Assistant Examiner*—Steven N. Meyers
*Attorney, Agent, or Firm*—Millen & White

[57] ABSTRACT

The shoe consists of a shell (1) made of synthetic plastics material and has a bellows-like corrugation on the surface of the shell (1) in the area (2) of the roots of the toes. Ridges (3) and furrows (4) extending transversely to the longitudinal direction are provided, which, when viewed from above, are seen to be arranged asymmetrically and run backward towards the outside (10) of the foot. (FIG. 3).

2 Claims, 3 Drawing Figures

SHOE OR BOOT

BACKGROUND OF THE INVENTION

The invention relates to a shoe or boot with a shell made of elastomeric material, in particular synthetic plastics material, and more particularly, a hiking boot, in which the upper part of the shell in the area of the roots of the toes is corrugated like a bellows, with ridges and furrows extending transversely to the longitudinal direction, each ridge on the outside lying opposite a furrow on the inside and each furrow on the outside lying opposite a ridge on the inside. Shells of synthetic plastics material which are fairly thick offer considerably resistance against bending, thus making walking difficult. If the shell is very thin, on the other hand, its resistance to pressure from outside is low, and the show becomes unsightly.

In the German published patent application No. 2,409,907, a sports shoe has already been disclosed which has a row of pleats in the area of the instep to improve the flexibility of the shoe. In this prior art construction, however, the kinematics of the rolling movement during walking or running has not been taken into consideration sufficiently to enable these prior art features to also be employed effectively with stiff ski boot shells or stiff climbing boot shells.

SUMMARY OF THE INVENTION

The object of the present invention is to improve further the flexibility of a shoe or boot with a shell made of elastomeric material or synthetic plastics material and thus, to facilitate walking. The invention resides basically in that the ridges and furrows, when viewed from the top, are arranged asymmetrically and extend obliquely backward towards the outside of the foot. In a leather shoe, creases due to walking develop which are not vertical to the center line of the shoe, but extend obliquely outward and backward. Because the arrangement of the corrugations in this embodiment are in accordance with such naturally occurring walking creases, bending of the shell is facilitated and the comfort to the wearer is substantially improved.

Viewed from the top, the ridges and furrows appropriately run in an arched line, with the peak of the arch directed towards the front. In this way too the direction of the ridges and furrows is better adapted to the bending of the shoe. Deformations occurring during bending are absorbed by the bellows-like corrugations, thus preventing uncontrolled formation of creases. If the thickness selected for the wall of the shell is very small, bending is facilitated, but the shell bulges outward a great deal when the foot is bent and buckles at its weakest point, as elastomers and resilient synthetic plastics material cannot be compressed as leather can. At this point where the shell buckles, there is an increased danger of cracking, and furthermore the shoe becomes unsightly. Thanks to the bellows-like design in the critical area where bending takes place, this bending is distributed across the various ridges and furrows. The depth of the furrows remains virtually unchanged during bending, so that the formation of deep creases during walking, which would exert pressure on the foot and cause a danger of cracking, is prevented, and furthermore no unattractive creases develop. With this type of bellows-like design with ridges and furrows, the attractive appearance of the shoe or boot is maintained despite constant bending. In this respect, the base of the furrows on the outside and the base of the furrows on the inside preferably should lie within the same geometric enveloping surface equidistant to the surface of the shell. In this way the bellows is most fully effective.

According to an advantageous embodiment of the invention, the ridges and furrows extend at least partially over the side walls of the shell, so that bending of the side walls is also provided for. The closer the wall of the shell is to the sole, the less it is bent during walking, and this may be provided for in accordance with the invention in that the depth of the furrows in the area of the side walls decreases progressively.

BRIEF DESCRIPTION OF THE DRAWINGS

In the drawings, the invention is illustrated schematically in one of its embodiments.

DETAILED DISCUSSION OF THE INVENTION

Figure 1:
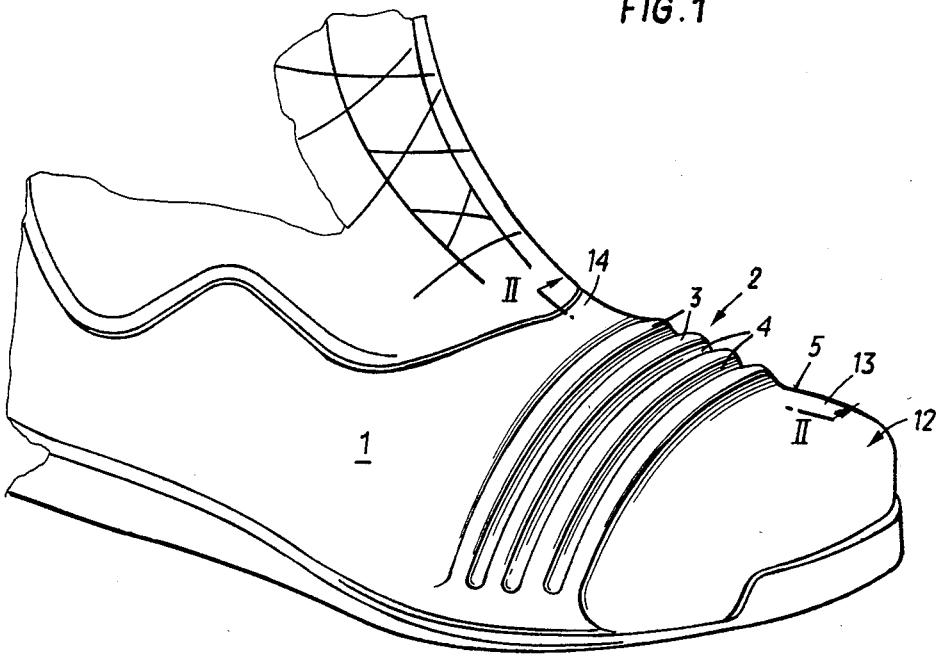
FIG. 1 shows the shoe in a perspective view.
Figure 2:
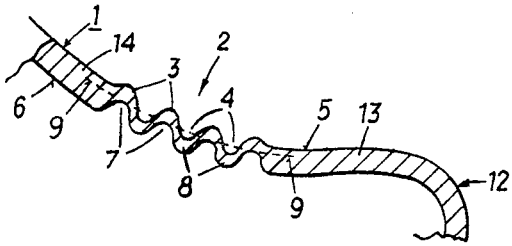
FIG. 2 shows a cross-section of the shoe along the center line, i.e., a cross-section along the line II—II pictured in FIG. 1.

The shell 1 of the shoe is designed with ridges and furrows in the area 2 of the roots of the toes. These ridges and furrows create a bellows-like area in which the shell 1 preferably tends to bend. On the outside 5 there are ridges 3 with furrows 4 between them. On the inside 6 there are furrows 7 lying opposite the ridges 3 on the outside and ridges 8 lying opposite the furrows 4 on the outside. The depth of the furrows 4 and 7 is such that the base of these furrows lies approximately in the same geometric enveloping surface 9 equidistant to the surface of the shell. In the area 13 facing the toe cap 12 and in the area 14 facing the instep, the wall of the shell 1 is thicker than in the bellows-like area 2.

Figure 3:
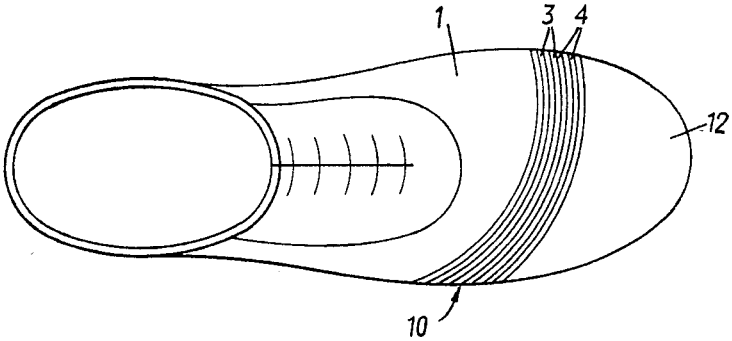
FIG. 3 shows a top view of a modified embodiment of the shell.

FIG. 3 shows a top view of a modified embodiment. The ridges 3 and furrows 4 are arranged asymmetrically and run obliquely backward towards the outside of the foot 10, so that their position is approximately the same as that of the creases caused by walking which occur naturally in a leather shoe.

What is claimed is:

1. A shoe, boot or hiking boot comprising a shell of selected thickness constructed of elastomeric material, said shell being corrugated in a bellows like construction in the region of said shell corresponding to the roots of a users toes when said shoe, boot or hiking boot is worn, said corrugations being made up of ridges (3) and furrows (4) extending in a direction substantially transverse to the longitudinal axis of said shell, and when seen from the top of said shell, arranged asymmetrically and running obliquely backward towards the lateral portion (10) of the foot in an arch with the apex thereof directed toward the front of said shell, each ridge (3) on the outside of said shell lying opposite a furrow (7) on the inside of said shell, and each furrow (4) on the outside lying opposite a ridge (8) on the inside, the base of the furrows (4) on the outside and the base of the furrows (4) on the inside lying in approximately the same geometric enveloping surface equidistant to the surface of the shell, and the depth of the furrows (4) in the area of the side walls of said shell decreasing progressively as compared to the depth of the furrows in the top of said shell with the thickness of the shell in the region of said ridges (3) and furrows (4) being less than the thickness of the remaining portion of the shell.

2. A shoe, boot or hiking boot as in claim 1, wherein said elastomeric material is a synthetic plastic.

* * * * *